US007788947B2

(12) United States Patent
Loetscher et al.

(10) Patent No.: US 7,788,947 B2
(45) Date of Patent: Sep. 7, 2010

(54) BRACELET OR WRISTBAND OF ADJUSTABLE LENGTH

(75) Inventors: Philippe Loetscher, Evillard (CH); Clément Meyrat, Le Landeron (CH)

(73) Assignee: The Swatch Group Management Service AG, Biel (CH)

( * ) Notice: Subject to any disclaimer, the term of this patent is extended or adjusted under 35 U.S.C. 154(b) by 567 days.

(21) Appl. No.: 11/690,301

(22) Filed: Mar. 23, 2007

(65) Prior Publication Data

US 2007/0220919 A1 Sep. 27, 2007

(30) Foreign Application Priority Data

Mar. 24, 2006 (EP) ..... 06111714

(51) Int. Cl.
*A44C 5/00* (2006.01)
*F16G 11/00* (2006.01)

(52) U.S. Cl. ..... 63/3.2; 24/115 H; 63/5.1

(58) Field of Classification Search ..... None
See application file for complete search history.

(56) References Cited

U.S. PATENT DOCUMENTS 1,124,518 A * 1/1915 Qvarnstrom ..... 24/115 H
2,457,195 A * 12/1948 Bagnall, Jr. ..... 24/3.13
5,168,480 A 12/1992 Dodier
5,212,966 A 5/1993 Minami
6,564,582 B1 * 5/2003 Brachfeld ..... 63/3.2
2002/0139141 A1 10/2002 Kuwayama
2003/0182770 A1 10/2003 Koshoji

FOREIGN PATENT DOCUMENTS

JP 10042917 2/1998

OTHER PUBLICATIONS

European Search Report issued in corresponding application No. EP 06 11 1714, completed Jul. 19, 2006.

* cited by examiner

*Primary Examiner*—Jack W. Lavinder
(74) *Attorney, Agent, or Firm*—Griffin & Szipl, P.C.

(57) ABSTRACT

The invention concerns a bracelet or wristband of adjustable length, including:

a first link including two ends defining first and second fixed points of attachment, a stopper including a through hole that allows the link to pass therethrough, releasable means for locking the link in the hole, and means for securing one of the ends of the link, and a securing element associated with the first point of attachment, the link being on one hand secured to the stopper by the second fixed point of attachment using the securing means, and on the other hand engaged in the hole so as to be able to be locked at a variable locking point, by the locking means, or to slide therein when the locking means are released, and the link further comprising, a variable point of attachment located substantially halfway between the second fixed point of attachment and the variable locking point (42).

16 Claims, 5 Drawing Sheets

Prior Art

BRACELET OR WRISTBAND OF ADJUSTABLE LENGTH

This application claims priority from European Patent Application No. 06111714.9, filed Mar. 24, 2006, the entire disclosure of which is incorporated herein by reference.

FIELD OF THE INVENTION

The invention relates to the field of horology or jewellery. It concerns more precisely a bracelet or wristband whose length is continuously adjustable.

BACKGROUND OF THE INVENTION

In horology and jewellery, the length of a bracelet or wristband is generally adjustable in a discontinuous manner. For a watch strap made of leather, for example, only a few predetermined fastening positions are possible. For a metal bracelet with links that may or may not be hinged, whether this concerns a watch wristband or an ornamental bracelet, the length varies by steps corresponding to the width of one link. Fine adjustment of the length of a bracelet or wristband is, consequently, rarely possible.

One solution to this difficulty is to introduce, into the bracelet or wristband, a link associated with a system for adjusting the useful length of the link. The bracelet can then be wholly, or only partially form of the link. The adjustment system can, for example, be formed by a stopper of the type used in sports articles, such as sleeping bags, double bag, or weather protective clothing. This type of stopper is described, amongst other places, in JP Patent No. 10042917.

However, two configurations are generally adopted for adjusting the useful length of a link using a stopper. In a first configuration illustrated by FIG. 1*a*, the stopper excludes one portion of the link in the form of a loop located between its two ends. The useful length of the link is equal to the sum of the lengths of the portions taken, respectively, between the ends and stopper. In a second configuration, illustrated in FIG. 1*b*, the stoppers exclude two link portions located between the ends and the closest stopper. The useful length of the link is equal to the length of the portion taken between the two stoppers.

Whichever configuration is adopted for adjusting the useful length of a link, at least one link portion is excluded and remains hanging in an unattractive manner and is liable to catch on an uneven surface.

SUMMARY OF THE INVENTION

The present invention overcomes this drawback by proposing a bracelet for a watch or jewellery that is continuously adjustable, comprising a link and a stopper defining a useful length of the variable link, without excluding any portion of the link.

More precisely, the invention concerns a bracelet or wristband whose length can be adjusted, including:

- a first link including two ends defining a first and second fixed point of attachment;
- a stopper including a through hole able to let the link pass therethrough, releasable means for locking the link in the hole, means for securing one of the ends of the link, and
- a securing element associated with the first point of attachment, the link being on the one hand fixed to the stopper by the second fixed point of attachment via said securing means, and on the other hand engaged in the hole so as to be able to be locked therein at a variable locking point, by the locking means, or to slide therein when the locking means are released, and the link further comprising, a variable point of attachment located substantially halfway between the second fixed point of attachment and the variable locking point, Owing to the presence of the attachment means on the stopper, and to the arrangement of the link relative to the stopper, the useful length of the link can vary continuously, substantially by a factor of one and a half.

The invention also concerns a stopper including a body provided with a hole of axis BB able to allow a link to pass therethrough, and releasable means for locking the link inside the hole, characterized in that it further includes attachment means for the end of a link.

BRIEF DESCRIPTION OF THE DRAWINGS

Other features and advantages of the present invention will appear more clearly from the following detailed description of an example embodiment of the bracelet or wristband according to the invention, this example being given purely by way of non-limiting example, with reference to the annexed drawings, in which.

DETAILED DESCRIPTION OF THE ILLUSTRATIVE EMBODIMENTS

Figure 1A:
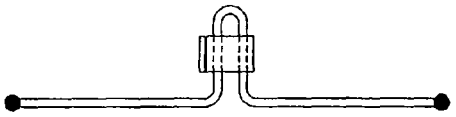
Fig. 1a Prior Art
FIGS. 1*a*, 1*b* are simplified views of conventional adjustment systems for adjusting the useful length of a link using at least one stopper.
Figure 1B:
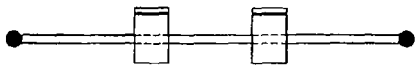
Figure 2A:
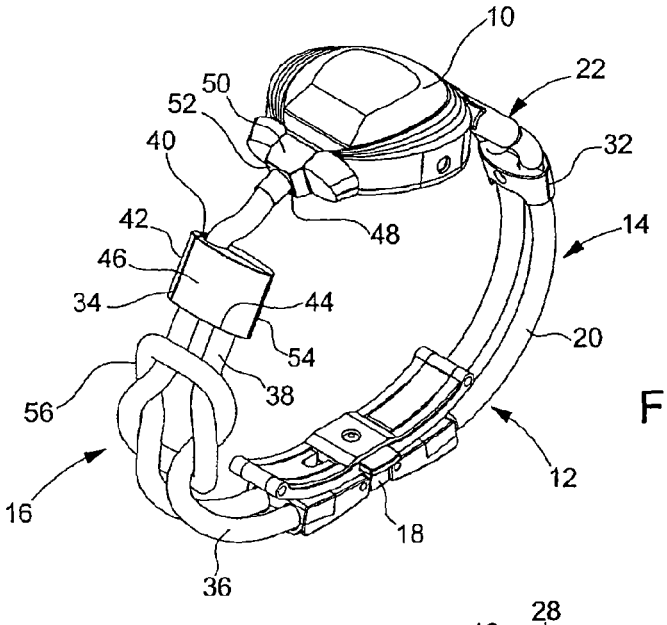
FIGS. 2*a*, 2*b* are perspective top and bottom views of a watch including a bracelet or wristband according to the invention.
Figure 2B:
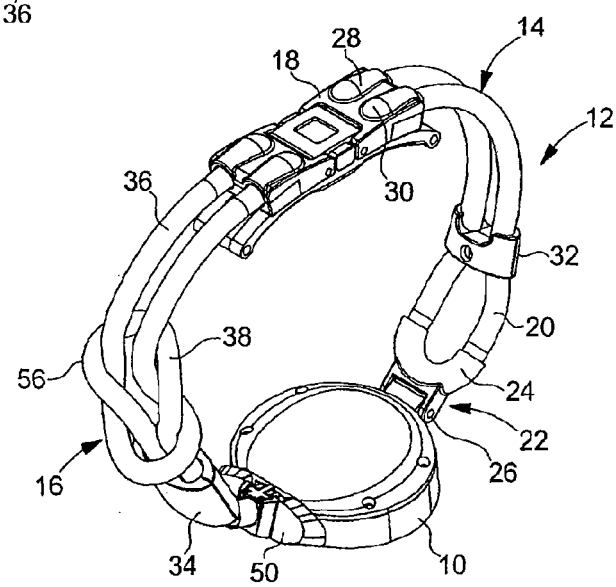

The wristwatch shown in FIGS. 2*a* and 2*b* includes in a conventional manner a case 10 and a watchband 12 for the watch to be worn on the wrist. Watchband 12 is formed of a strand 14 of fixed length, a strand 16 of adjustable length and a clasp 18. Each strand 14, 16 is secured by one end to case 10 and by the other end to clasp 18. Clasp 18 is of the unfolding type, but, in another variant, it could be formed of two distinct parts, in a conventional manner.

Strand 14 is formed of a link 20, for example a metal cable, a cord or leather strap, folded in two so as to form a U, whose two ends are secured to clasp 18 and the curved portion, to case 10. For this purpose, a connecting part 22, comprising a curved tubular portion 24, is hinged onto case 10 using a hinge 26, and link 20 is threaded on as far as its median portion approximately in tubular portion 24. Moreover, clasp 18 comprises two substantially cylindrical housings 28 and 30 in which the ends of link 20 are friction fitted. An element 32 including two through holes is mounted on link 20 approximately at mid-length, in order to hold the two branches of the U formed by link 20, close and substantially parallel. The useful length of link 20 is equal to half of the length thereof.

Strand 16 includes a stopper 34 for adjusting its length and two links 36 and 38 secured to each other such that a relative sliding movement is possible. Stopper 34 includes in a conventional manner a through hole 40 for the passage of a link and releasable means 42 for locking the link. It further includes means 44 for securing one link end. Stopper 34 will be described in more detail with reference to FIGS. 7 and 8.

Link 36 is folded in two so as to form a U and its ends are secure to clasp 18 in the same way as link 20. The useful length of the link 36 is fixed and equal to half of the length thereof.

Link 38 is also folded in two so as to form a U, one branch of which is longer than the other. The longer branch is engaged in hole 40 of stopper 34 as far as a locking point 46 defined as the place on link 38 where locking means 42 act. Its end is fixed to case 10 and forms a first fixed point of attachment 48 for link 38. For this purpose, case 10 includes a fixing element 50 provided with a cylindrical housing 52 in which this end is locked. The end of the shorter branch is secured to stopper 34 by securing means 44, and forms a second fixed point of attachment 54 for link 38.

Link 36 and link portion 38 comprised between locking point 46 and the second fixed point of attachment 54, are interlaced, so as to form a very loose flat knot forming a variable point of attachment 56 for link 38. Links 36 and 38 are thus secured while remaining free to slide in relation to each other.

It will be noted that the useful length of link 38 is equal to the length of the longer branch of the U. i.e. the length taken between the first fixed point of attachment 48 of link 38 and the variable point of attachment 56. This length is variable owing to the presence of stopper 34. In practice, it can vary substantially from the length of link 38 to half of the length thereof, without any link portion being excluded.

The watch formed of wristband 12 and case 10 is slipped onto the wrist in a conventional manner owing to the opening and closing of clasp 18. Its length is adjusted via stopper 34 associated with link 38. When locking means 42 for stopper 34 are active, the length of wristband 12 is fixed and determined by the useful length of link 38. When locking means 42 for stopper 42 are releasable, link 38 can slide inside hole 40 to vary locking point 46 and the useful length of link 38. Link 38 slides in relation to link 36 at variable point of attachment 56, and the useful length of link 38 varies continuously. The length of the wristband or bracelet according to the invention can thus be finely adjusted, in an extremely simple manner.

Figure 3:
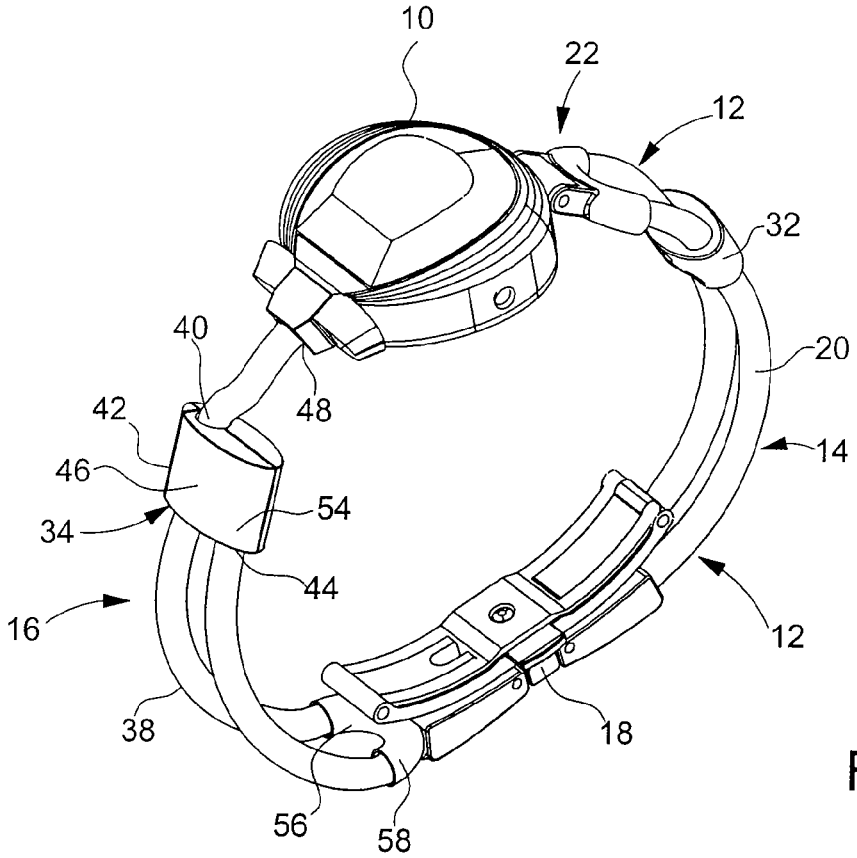
FIGS. 3, 4 and 5 are perspective views of three variants of the watchband according to the invention.

In a first variant of the wristwatch shown in FIG. 3, link 36 is absent, and, with stopper 34, link 38 forms strand 16. As previously, link 38 is secured via one of the ends thereof forming a first fixed point of attachment 48 to case 10. moreover, it is fixed, via its variable point of attachment 56, to clasp 18. For this purpose, clasp 18 comprises a tubular portion 58 into which link 38 slips, so as to be able to slide freely therein. Thus, when the length of link 38 is adjusted, the latter slides inside tubular portion 58 and its useful length varies continuously.

Figure 4:
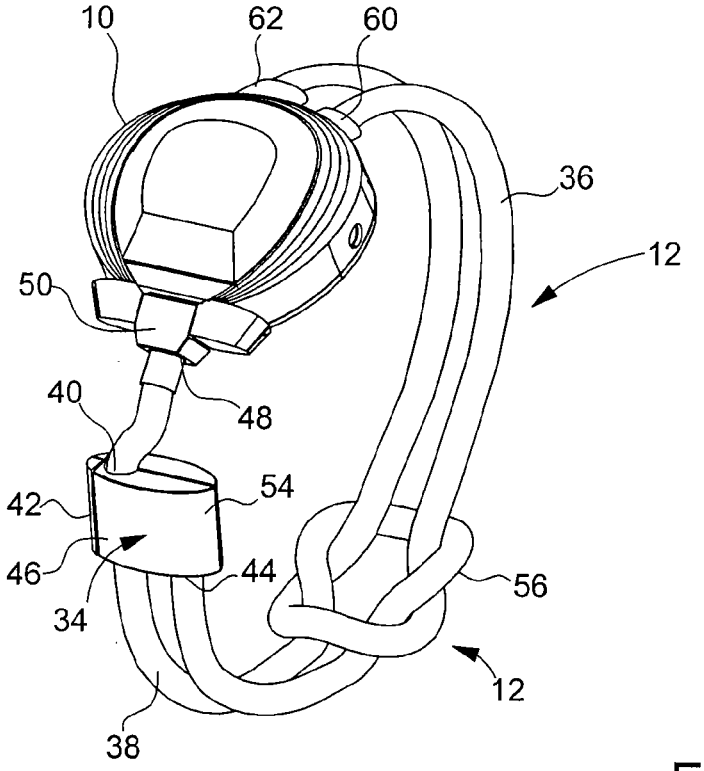

A second variant of the wristwatch shown in FIG. 4, differs from the embodiment illustrated in FIG. 2*a*, 2*b*, in that link 20 and clasp 18 are absent from wristband 12. In this version, link 36 is folded in two to form a U and secured via its ends to case 10. For this purpose, case 10 is provided with two cylindrical housings 60 and 62 inside which the ends of link 36 are tightly fitted. Link 36 and link portion 38 comprised between locking point 46 and the second determined point of attachment 54, are interlaced, so as to form a very loose flat knot forming variable point of attachment 56 for link 38. Links 36 and 38 are thus secured while remaining free to slide in relation to each other. It will be noted that in this wristwatch variant, in the absence of clasp 18, the maximum length of wristband 12 has to allow a hand to pass through in order for the watch to be put on. Conversely, wristband 12 must be able to grip the user's wrist. Link 36 and link 38, whose length is adjustable, must thus be sized accordingly.

Figure 5:
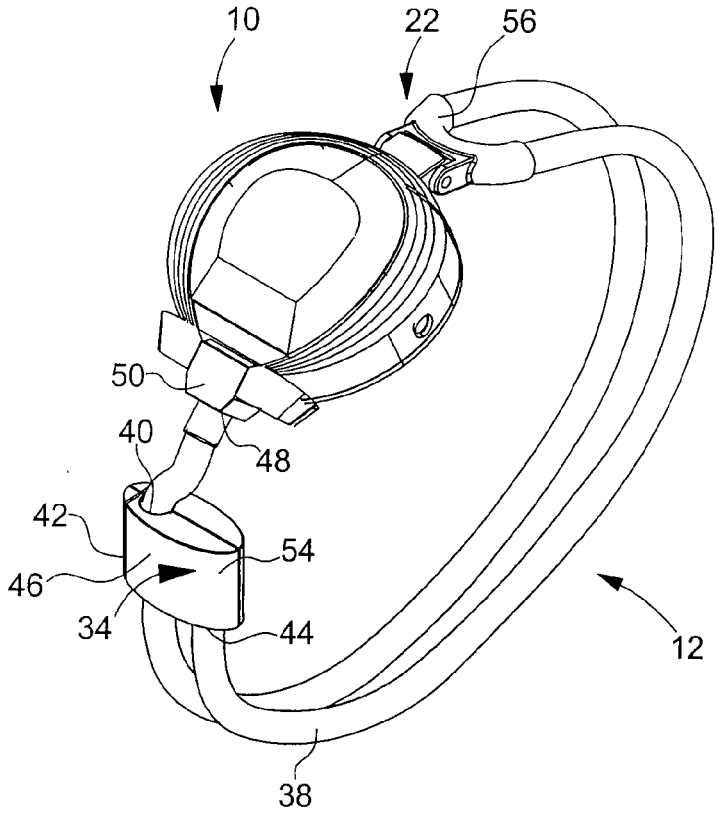

Finally, in a third variant of the wristwatch shown in FIG. 5, wristband 12 is formed solely of adjustable link 38. As in the preceding versions, link 38 is secured via one of its ends forming a first fixed point of attachment 48 to case 10. Moreover, it is secured, via its variable point of attachment 56, to case 10 via connecting part 22. As in the second variant, link 38 must be sized to allow the user's hand to pass through, and to allow wristband 12 to be tightened around the wrist.

Figure 6:
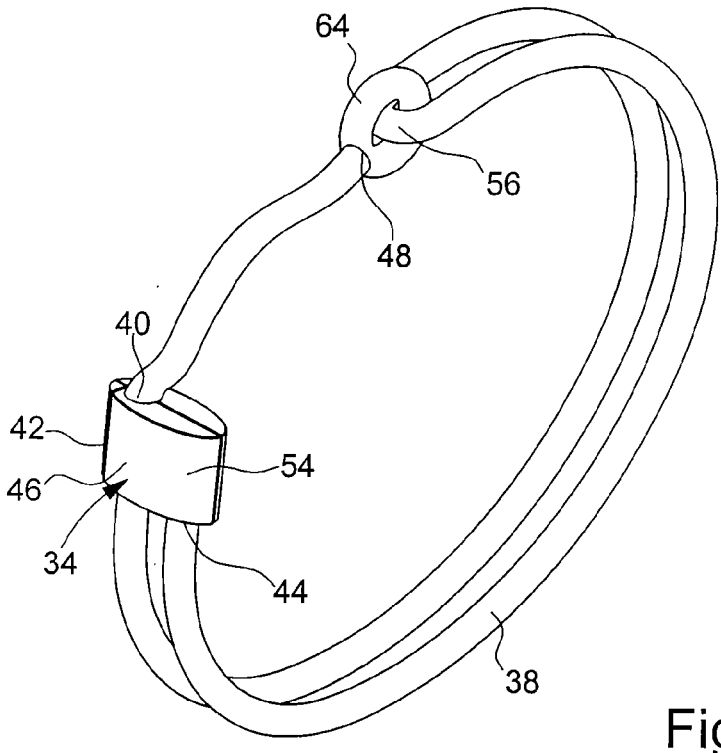
FIG. 6 is a perspective view of an ornamental bracelet according to the invention, and FIGS. 7 and 8, respectively a, b, c and d are respectively top, and cross-sectional views of two stopper variants according to the invention.

FIG. 6 shows an ornamental bracelet formed solely of link 38 that closes on itself. Thus, the first fixed point of attachment 46 of link 38 is provided with a ring 64 in which the portion comprised between locking point 46 and the second fixed point of attachment 54 is threaded. Ring 64 can be formed of a clasp for opening and closing the bracelet.

Whichever variant of bracelet or wristband 12 is used for a wristwatch or a piece of jewellery, it will be noted that link 38, associated with stopper 34, comprises three points of attachment. Two of these points of attachment 48 and 54 are fixed and correspond to the two ends of link 38. The third point 56 does not occupy a defined position on link 38, but is variable as a function of the useful length of the latter. It is located substantially halfway between locking point 46 and the fixed end of stopper 34.

Moreover, whatever the variant of bracelet 12, the stopped used must comprise means for securing one link end. Two stopper examples are described with reference to FIGS. 7 and 8.

Figure 7A:
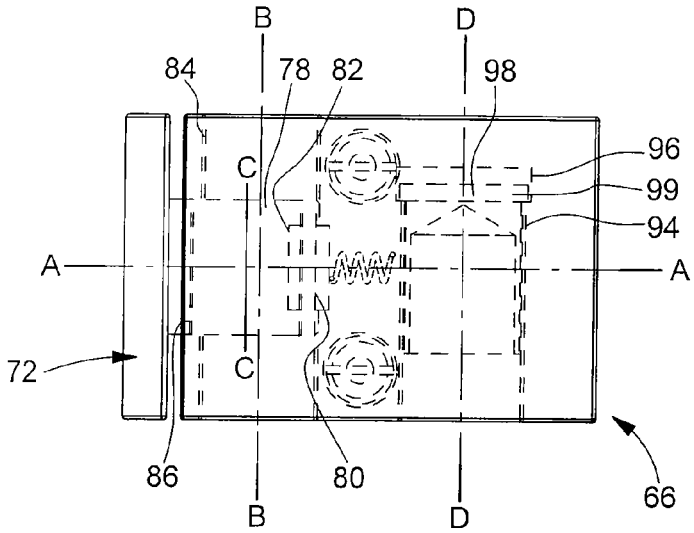
Figure 7C:
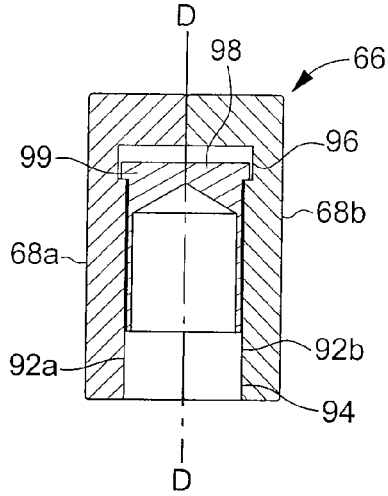
Figure 7B:
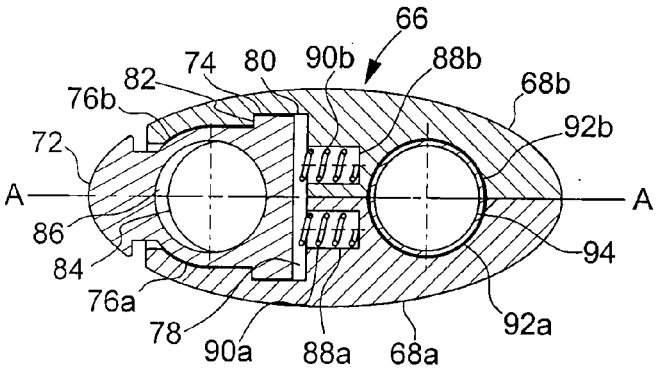
Figure 7D:
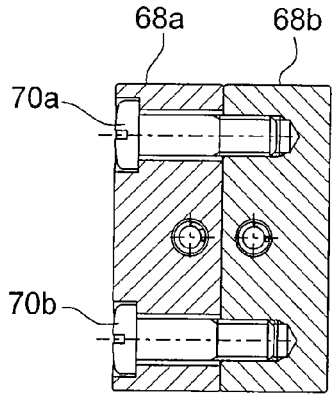

The stopper shown in FIGS. 7*a, b, c* and *d* comprises in a conventional manner a body 66, formed of two shells 68*a* and 68*b* assembled to each other using two screws 70*a* and 70*b*, and a piston 72 provided with a shoulder 74. Shells 68*a* and 68*b* comprise two recesses, respectively 76*a* and 76*b*, which together define a housing 78 of longitudinal axis AA. A groove 80 extending at the bottom of housing 78, forms a stop member 82. Piston 72 is mounted to move in translation in housing 78, shoulder 74 being housed in groove 80. Its travel is limited, on one hand, by the bottom of shoulder 78, and on the other hand by stop member 82 against which shoulder 74 abuts. A first hole 84 with an axis of symmetry BB perpendicular to AA, passes through body 66 at the height of housing 78. A second hole 86 with an axis of symmetry CC parallel to BB passes through piston 72, such that holes 84 and 86 are coaxial at one point on the travel of piston 72. Two cavities 88*a* and 88*b*, made at the bottom of housing 78, act as a housing for two springs respectively 90*a* and 90*b*, which abut on the bottom of piston 72. Piston 72 forms, with housing 78 and springs 90*a* and 90*b*, the releasable locking means 42, mentioned hereinbefore.

When the stopper is at rest, springs 90*a* and 90*b* exert a force on piston 72 tending to expulse it from housing 78. The piston abuts against the stop member 82 and holes 84 and 86*b* are then not centred. An application of pressure on piston 72 compresses springs 90*a* and 90*b* and aligns holes 84 and 86. it is then possible for a link of substantially equal diameter to the diameter of holes 84 and 84 to be freely engaged in holes 84 and 86. When the pressure is released, the force exerted by springs 90*a* and 90*b* is no longer compensated for and the piston is again pushed outside housing 78. Holes 84 and 86 tend to move off-centre, such that piston 72 and body 66 exert a shearing-type force on the link. Via the effect of this shearing-type force, the link is locked inside hole 84.

Shells 68*a* and 68*b* further comprise two recesses 92*a* and 92*b* in the shape of a semi-cylinder, together defining a cylindrical hole 94 with an axis DD parallel to axes BB and CC. The bottom of hole 94 is formed of a circular groove 96. An end portion 98 to be fitted to the end of a link is housed in hole 94. End portion 98 is thus formed of a cylindrical part provided with a shoulder 99 positioned axially and radially in groove 96. With hole 94, end portion 98 forms the securing means 44 described hereinbefore.

Figure 8A:
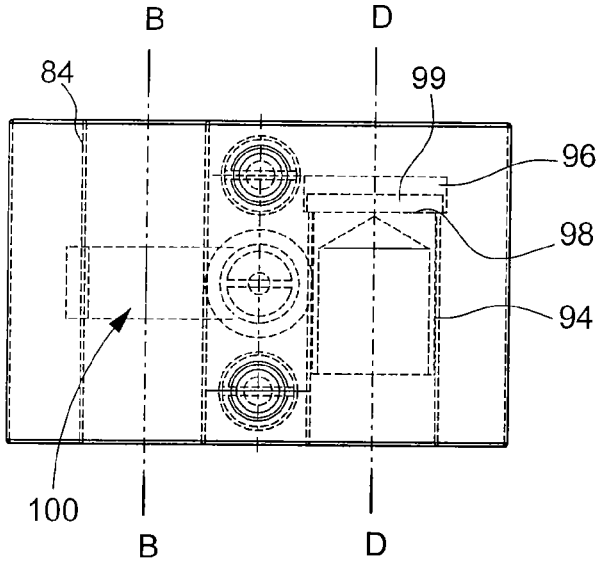
Figure 8C:
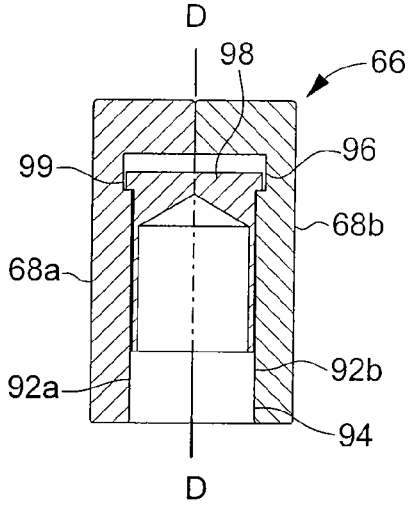
Figure 8B:
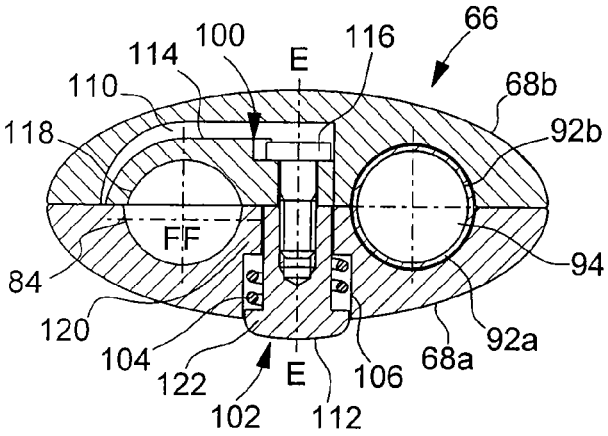
Figure 8D:
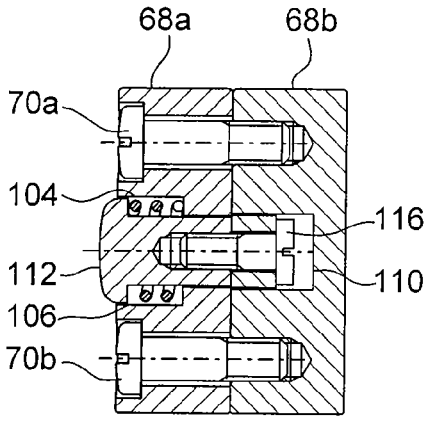

A stopper variant according to the invention is shown in FIGS. 8*a, b, c* and *d*. This stopper differs from the preceding one via its locking means 42, formed of a housing 100, a piston 102 mobile inside housing 100 and a spring 104. Housing 100 includes a first substantially cylindrical portion 106 with an axis EE perpendicular to axis BB of hole 84 located in shell 68*a*. A second portion 110 extends into shell 68*b*, perpendicular to axis EE and to axis BB, between portion 106 and hole 84. The piston is formed of a substantially cylindrical element 112 housed in the housing portion 106 and of a substantially parallelepiped element 114 housed in housing portion 110. Elements 112 and 114 are secured and fixed using a screw 116. Element 114 comprises a hollow 118 forming a cylindrical portion with an axis FF off-centre in relation to axis BB when element 114 is abutting against shell 68*a*. Element 114 thus slightly closes hole 84 at housing 100 when it is abutting against shell 68*a*.

Spring 104 is mounted to be substantially compressed on cylindrical element 112. For this purpose, housing portion 106 and cylindrical element 112 each comprise a shoulder respectively 120 and 122 forming two stop members located opposite each other, between which spring 104 is compressed.

When there is no pressure exerted on piston 102, spring 104, which is substantially compressed, exerts a thrust on the piston 102 tending to expulse it from its housing 100. Parallelepiped element 114 is then pressed against shell 68*a* and hole 84 is slightly closed. An application of pressure on piston 102 further compresses spring 104, and moves element 114 away from shell 68*a*. Hole 84 is released and a link of substantially equal diameter to the diameter of hole 84 can be engaged therein. When the pressure on piston 102 is released, the spring again presses element 114 against shell 68*a*. Element 114 then exerts a compression force on the link, thereby locking it in hole 84.

Like the stopper previously described, this stopper variant includes means 44 for securing a link end. These securing means 44 can, for example, be of the type already described, but any other securing means could be envisaged by those skilled in the art.

It goes without saying that the present invention is not limited to the embodiments that have just been described and that various simple alterations and variants could be envisaged by those skilled in the art without departing from the scope of the invention as defined by the annexed claims.

What is claimed is:

1. A bracelet or wristband of adjustable length, characterized in that it includes:

a first link including two ends defining first and second fixed points of attachment, a stopper including a through hole that allows said link to pass therethrough, releasable means for locking the link in said hole, and means for securing one of the ends of said link, and a securing element associated with said first point of attachment, said link being on one hand secured to the stopper by said second fixed point of attachment using said securing means, and on the other hand engaged in said hole so as to be able to be locked at a variable locking point, by said locking means, or to slide therein when said locking means are released, and said link further comprising, a variable point of attachment located substantially half-way between the second fixed point of attachment and the variable locking point, wherein said locking means include a hole and an end portion to be fitted to the end of a link, said hole and said end portion being provided with radial and axial positioning means for the end portion inside the hole, and wherein said positioning means are formed of a circular groove extending from the bottom of said hole and a shoulder located at the end of said end portion.

2. A bracelet or wristband of adjustable length including:

(a) a first link including two ends defining first and second fixed points of attachment;

(b) a stopper including a through hole that allows the first link to pass therethrough, releasable means for locking the first link in the through hole, and means for securing one of the ends of the first link; and (c) a securing element associated with the first fixed point of attachment, wherein the first link is on one hand secured to the stopper by the second fixed point of attachment using the securing means, and on the other hand engaged in the through hole so as to be able to be locked at a variable locking point by the locking means, or so as to slide therein when the locking means are released, wherein the first link further includes a variable point of attachment located substantially half-way between the second fixed point of attachment and the variable locking point, wherein the length of the bracelet or wristband is continuously adjustable, wherein said locking means include a hole and an end portion to be fitted to the end of a link, said hole and said end portion being provided with radial and axial positioning means for the end portion inside the hole, and wherein said positioning means are formed of a circular groove extending from the bottom of said hole and a shoulder located at the end of said end portion.

3. A stopper including a body provided with a first through hole having an axis BB able to allow a link to pass therethrough, releasable means for locking the link inside the hole, and securing means for the end of a link, wherein said securing means are formed of a blind hole and an end portion to be fitted to the end of a link, said hole and said end portion being provided with means for the axial and radial positioning of the end portion inside the hole, and wherein said positioning means are formed of a circular groove extending at the bottom of the blind hole and a shoulder located at the end of said end portion.

4. A stopper including a body provided with a first through hole having an axis BB able to allow a link to pass therethrough, and releasable means for locking the link inside the hole, wherein it further includes securing means for the end of a link, wherein said securing means are formed of a blind hole and an end portion to be fitted to the end of a link, said hole and said end portion being provided with means for the axial and radial positioning of the end portion inside the hole, and wherein said positioning means are formed of a circular groove extending at the bottom of the blind hole and a shoulder located at the end of said end portion.

5. A bracelet or wristband of adjustable length including:

(a) a first link including two ends defining first and second fixed points of attachment;

(b) a stopper including a through hole that allows the first link to pass therethrough, releasable means for locking the first link in the through hole, and means for securing one of the ends of the first link; and (c) a securing element associated with the first fixed point of attachment, wherein the first link is on one hand secured to the stopper by the second fixed point of attachment using the securing means, and on the other hand engaged in the through hole so as to be able to be locked at a variable locking point by the locking means, or so as to slide therein when the locking means are released, wherein the first link further includes a variable point of attachment located substantially half-way between the second fixed point of attachment and the variable locking point, wherein the length of the bracelet or wristband is continuously adjustable, and wherein the bracelet or wristband further including a second link secured to said first link by said variable point of attachment, such that relative sliding of said first link to said second link is possible.

6. The bracelet or wristband according to claim 5, wherein said second link forms, with said first link, a flat knot at said variable point of attachment.

7. The bracelet or wristband according to claim 5, wherein said second link includes two fixed points of attachment located at the two ends thereof.

8. The bracelet or wristband according to claim 5, further including a clasp, the ends of said second link being secured to said clasp.

9. The bracelet or wristband according to claim 8, further including a third link including a point of attachment to said clasp.

10. The bracelet or wristband according to claim 9, wherein said first link is secured to a case by said first fixed point of attachment using a securing element, and wherein said third link is also secured to said case using a connecting part so as to form a wristwatch.

11. A bracelet or wristband of adjustable length, characterized in that it includes:

a first link including two ends defining first and second fixed points of attachment, a stopper including a through hole that allows said link to pass therethrough, releasable means for locking the link in said hole, and means for securing one of the ends of said link, and a securing element associated with said first point of attachment, said link being on one hand secured to the stopper by said second fixed point of attachment using said securing means, and on the other hand engaged in said hole so as to be able to be locked at a variable locking point, by said locking means, or to slide therein when said locking means are released, and said link further comprising, a variable point of attachment located substantially half-way between the second fixed point of attachment and the variable locking point, wherein the bracelet or wristband further includes a second link secured to said first link by said variable point of attachment, such that relative sliding of said first link to said second link is possible.

12. The bracelet or wristband according to claim 11, wherein said second link forms, with said first link, a flat knot at said variable point of attachment.

13. The bracelet or wristband according to claim 11, wherein said second link includes two fixed points of attachment located at the two ends thereof.

14. The bracelet or wristband according to claim 11, further including a clasp, the ends of said second link being secured to said clasp.

15. The bracelet or wristband according to claim 14, further including a third link including a point of attachment to said clasp.

16. The bracelet or wristband according to claim 15, wherein said first link is secured to a case by said first fixed point of attachment using a securing element, and wherein said third link is also secured to said case using a connecting part so as to form a wristwatch.

* * * * *